US011439244B2

(12) United States Patent
Sodergren et al.

(10) Patent No.: US 11,439,244 B2
(45) Date of Patent: Sep. 13, 2022

(54) SOFT SEATING CONVERTIBLE CHAIR

(71) Applicant: Airtex Group, Minneapolis, MN (US)

(72) Inventors: Kacie Sodergren, Edina, MN (US); Marcia Lane, Minneapolis, MN (US); Laura Tadt, Minneapolis, MN (US); Amber Hove, Minnetonka, MN (US)

(73) Assignee: Airtex Group, Minneapolis, MN (US)

( * ) Notice: Subject to any disclaimer, the term of this patent is extended or adjusted under 35 U.S.C. 154(b) by 0 days.

(21) Appl. No.: 17/232,323

(22) Filed: Apr. 16, 2021

(65) Prior Publication Data

US 2021/0321783 A1 Oct. 21, 2021

Related U.S. Application Data

(60) Provisional application No. 63/011,415, filed on Apr. 17, 2020.

(51) Int. Cl.
*A47C 4/00* (2006.01)
*A47C 4/02* (2006.01)
(Continued)

(52) U.S. Cl.
CPC ..... *A47C 13/005* (2013.01); *A47B 85/04* (2013.01); *A47C 7/24* (2013.01); *A47C 7/546* (2013.01)

(58) Field of Classification Search
CPC ..... A47C 13/005; A47C 7/24; A47C 7/546
(Continued)

(56) References Cited

U.S. PATENT DOCUMENTS 950,253 A 2/1910 Trepel
1,077,189 A 10/1913 Hicks
(Continued)

FOREIGN PATENT DOCUMENTS

CN 1985708 A 6/2007
CN 106419206 A 2/2017
(Continued)

OTHER PUBLICATIONS

Brayden Studio, Rafia Palmar Convertible Chair, Wayfair (Seller); Mar. 6, 2020, 8 pgs.
(Continued)

*Primary Examiner* — Rodney B White
(74) *Attorney, Agent, or Firm* — Vedder Price P.C.

(57) ABSTRACT

A modular Soft Seating Convertible Chair is provided comprising a body having a seat attached to a back side, a plurality of zippers and at least two webbing straps attached at opposite ends of the body. The Soft Seating Convertible Chair can be converted into a chair or a table by configuring embedded common zippers to employ the convertible feature according to the individual needs and circumstances. The Soft Seating Convertible Chair is made of shredded foam inside the body in order to achieve an optimal balance between comfort and support for the end user. The Soft Seating Convertible Chair further comprises internal baffles to create chambers for the shredded foam. Foam material used with the modular Soft Seating Convertible Chair can be compressed during product shipment, thereby allowing the Soft Seating Convertible Chair to be packed tightly in a shipping container (e.g., a carton) without impacting the functionality of the finished product.

19 Claims, 4 Drawing Sheets

(51) Int. Cl.

| | |
|---|---|
| ***A47C 7/42*** | (2006.01) |
| ***A47C 13/00*** | (2006.01) |
| ***A47C 7/54*** | (2006.01) |
| ***A47C 7/24*** | (2006.01) |
| ***A47B 85/04*** | (2006.01) |

(58) Field of Classification Search
USPC ..... 297/378.1, 440.1, 440.14, 118, 119
See application file for complete search history.

(56) References Cited

U.S. PATENT DOCUMENTS 1,207,510 A 12/1916 Decker
1,787,245 A 12/1930 Graham
2,164,715 A * 7/1939 Krainbill ..... A47C 13/005 297/440.14 X
2,705,994 A * 4/1955 Stattler ..... A47C 7/407 297/378.1 X
2,829,707 A * 4/1958 Liebson ..... A47C 4/028 297/440.1 X
3,001,822 A * 9/1961 Pagliaro ..... A47C 4/08 297/440.1
3,183,036 A * 5/1965 Hill ..... A47C 4/028 297/440.1 X
3,773,329 A * 11/1973 Secter ..... A63F 9/088 297/440.14 X
3,817,573 A 6/1974 Facury
4,077,517 A * 3/1978 Hilemn ..... A47C 4/02 297/440.1
5,509,720 A * 4/1996 Croom ..... A63H 33/04 297/440.14 X
5,890,767 A * 4/1999 Chang ..... A47C 4/02 297/440.22
6,824,220 B1 * 11/2004 Davison ..... A47C 17/34 297/440.14
7,040,693 B1 * 5/2006 Dorner ..... A47C 17/18 297/118
7,181,783 B2 * 2/2007 O'Reilly ..... A47C 19/22 297/440.14
7,832,797 B2 11/2010 Miyakawa
8,646,843 B2 * 2/2014 Koch ..... A47C 17/02 297/440.14
8,721,000 B2 * 5/2014 Nguyen ..... A47C 7/02 297/378.1
8,783,778 B2 * 7/2014 Nelson ..... A47C 13/005 297/440.14 X
10,342,339 B2 7/2019 Chen
2006/0220435 A1 * 10/2006 Carter ..... A47C 1/124 297/440.14
2007/0052276 A1 * 3/2007 Hurvich ..... A47C 13/005 297/440.14
2007/0257539 A1 * 11/2007 White, III ..... A47C 13/005 297/440.14
2009/0315382 A1 * 12/2009 Nelson ..... A47C 13/005 297/440.1
2011/0233976 A1 * 9/2011 Hanson ..... A47C 4/028 297/440.14
2011/0309666 A1 * 12/2011 Genesin ..... A47C 13/005 297/440.14
2013/0102842 A1 * 4/2013 Zwezdaryk ..... A47B 85/00 5/2.1
2013/0193728 A1 * 8/2013 Wang ..... A47C 31/00 297/378.1
2014/0368010 A1 * 12/2014 Nelson ..... A47C 13/005 297/440.14
2016/0174715 A1 * 6/2016 Nelson ..... F16B 1/00 297/440.14
2018/0000251 A1 * 1/2018 Olsen ..... A47B 85/04
2019/0142165 A1 * 5/2019 Nelson ..... A47C 4/028 297/440.1
2020/0405064 A1 * 12/2020 Jones ..... A47C 27/085

FOREIGN PATENT DOCUMENTS

CN 107713427 A 2/2018
DE 20022213 U1 4/2001
DE 202018105596 U1 1/2020
EP 0420782 A1 * 4/1991 ..... A47C 13/005
FR 1385580 A 1/1965
KR 101559952 B 10/2015
KR 20170004160 U 12/2017

OTHER PUBLICATIONS

Benoit Lienart, Sweetch 18 by Benoit Lienert, Homebuildlife (Seller), Aug. 1, 2011, 2 pgs.

* cited by examiner

SOFT SEATING CONVERTIBLE CHAIR

This Application claims the benefit of and priority to U.S. Provisional Application No. 63/011,415, filed Apr. 17, 2020, the content of which is hereby incorporated by reference.

FIELD OF THE INVENTION

The present invention generally relates to a Soft Seating Convertible Chair with built-in improved configuration for different types of seating arrangements. More particularly, the present invention is directed to an improved multi-purpose Soft Seating Convertible Chair having a certain combination of materials and uniquely configured common zippers and snaps/straps to employ the convertible feature and convert the chair to a table or vice versa. More particularly, the present invention relates to an improved multi-purpose and multi-functional Soft Seating Convertible Chair.

BACKGROUND

The retail furniture market provides a variety of options and selections to consumers looking to purchase conventional or unconventional sofas, chairs, tables or other seating options. Although such products have traditionally provided a means of sitting and relaxing in both indoor and outdoor settings, when it comes to utilizing the same product both as a seating chair as well as a table, there is a dearth of such combination seating options.

The scarcity of options is more prevalent when it comes to the market for soft seating sofas/chairs. Conventional sofas/chairs or other seating arrangements commonly have a seat, two armrests at two opposite lateral sides of the seat and a padded backrest at the back side of the seat. In addition, some consumers need a certain configuration or orientation, such as for sofa/chair, for seating in the usual way or using it as a table during other times. Today, if a consumer wants to have the flexibility to customize or configure a sofa/chair for a different usage, it can be a very cumbersome and inefficient process, thereby making it almost impracticable for the user to use the same sofa/chair for differently configured arrangements.

Various attempts have been made to provide a convertible and multi-purpose functional sofa/chair offering different options depending on how the end user assembles/configures the various parts. To the extent a sofa/chair currently can provide convertibility, it requires cumbersome and inefficient adjustments by the end user in order to reposition for different types of usage.

The prior art does not provide options for a consumer/end user to configure one soft seating convertible chair into various configurations using easy-to-assemble and uniquely configured common zippers to employ the convertible feature.

There is a market need to develop a novel and useful, easy-to-adjust and convenient multi-purpose/multi-functional soft seating arrangement hinged on the back side that can be converted from a chair to a table or vice versa, by using embedded common zippers (or other similar closures) to employ the convertible feature. The hinged connection in the present invention, along with the common zippers, provide an improved convertible chair pivotable about a generally horizontal pivot axis to convert between a table and a chair.

Therefore, the present invention addresses a long-felt but unresolved need in the field of retail furniture—more specifically in the consumer sofa/chair market—to provide for a combination soft seating convertible chair configured to be used as a chair or table depending on the needs of the end user. Consumers can use such soft seating convertible chair as needed—by assembling/configuring the plurality of embedded zippers (and other similar arrangements providing similar functionality) according to the individual needs and circumstances.

SUMMARY

The apparatus and related methods described in the present invention address the drawbacks of existing designs for certain sofas/chairs and other related furniture, especially as it relates to easy-to-use multi-functional modular and compact convertible sofas/chairs.

An objective of the present invention is to provide a soft seating convertible chair having a combination of certain materials, along with a novel and uniquely configured plurality of zippers (and other similar arrangements providing similar functionality) to convert from sofa/chair to a table and vice versa for the different types of seating arrangements/needs based on user preferences.

Consumers can use such convertible chair as needed by assembling/configuring the plurality of common embedded zippers and other snaps/straps according to their individual needs and circumstances.

Embodiments disclosed in the present invention provide such an improved Soft Seating Convertible Chair that may be used for various purposes.

In an embodiment, a Soft Seating Convertible Chair having a seat, two armrests at two opposite lateral sides of the seat and a padded backrest at the back side of the seat is provided.

The Soft Seating Convertible Chair is designed and configured with a hinge on the back side of the Soft Seating Convertible Chair such that the Soft Seating Convertible Chair and can be used and converted from a sofa/chair to a table. It is to be noted that the ease of convertibility of the chair is dependent on how the end user configures the various embedded common zippers of the Soft Seating Convertible Chair to convert from a chair to a table and vice versa. By way of example and not of limitation, the Soft Seating Convertible Chair further comprises a unique and novel combination of materials such as certain types of wrinkle-proof and easily compressible soft knitted material. In the depicted embodiment, a Soft Seating Convertible Chair is designed and configured to convert to a chair or a table with minimal effort by the user.

In an embodiment, a Soft Seating Convertible Chair is designed and configured using certain combinations of materials. More particularly, the improved Soft Seating Convertible Chair comprises an outer shell filled with a specific type of inner material. In the depicted embodiment, the outer shell is made of a certain type of textile material filled with shredded foam (for the inner material).

In the depicted embodiment, the inner material of the Soft Seating Convertible Chair comprising shredded foam allows the improved chair to be compressed inside the shipping carton without any impact to the unique functionality of the product. By way of example and not of limitation, in the depicted embodiment, the usage of shredded foam further provides an optimal balance between comfort and structure for the end user.

In another embodiment, a board (or any other sheet of material with similar functional and operational characteristic) is inserted and embedded in the back side of the Soft Seating Convertible Chair. In the depicted embodiment, the inserted board or other material will provide additional stability and structural support when the user converts the product into the table form while keeping the Soft Seating Convertible Chair as flat as possible for shipment. It is to be noted that the insertion of such material in the back side of the Soft Seating Convertible Chair creates a firm table top when the chair is converted to a table by the user. The board can be made of a sheet of plastic, wood, paper or any other material with equivalent characteristics and functionality to produce the firmness for a converted table top.

In another embodiment, a Soft Seating Convertible Chair is provided wherein the shape of the convertible chair can be modified without sacrificing or compromising any quality or functionality of the product. By way of example and not of limitation, in the depicted embodiment, the back of the chair can be square, rounded or any other equivalent shape.

In another embodiment, a Soft Seating Convertible Chair is provided in which the arms of the chair can be rounded or squared and still provide the same functionality and/or configurability—to convert from chair to table and vice versa for the different types of needs based on user preferences. In the depicted embodiment, a plurality of built-in and embedded zippers are used on either side of the chair back to attach the back of the chair to the arms/base of the Soft Seating Convertible Chair. By way of example and not of limitation, the plurality of zippers can be substituted with Velcro, snaps or buckles to create the same functionality and/or configurability for the Soft Seating Convertible Chair—as a chair or a table depending on the needs of the user.

It is the intent of this invention that any type of material that will retain the functionality and configuration of the Soft Seating Convertible Chair can be used as inner material for the product. By way of example and not of limitation, various kinds of foams, including but not limited to, shredded foam or other similar types of foam can be used as the internal material of the Soft Seating Convertible Chair. In addition, the Soft Seating Convertible Chair comprises built-in internal baffles to create chambers for the foam. By way of example, and not of limitation, materials comprising polystyrene beads can also be used within the baffle of the Soft Seating Convertible Chair.

In yet another embodiment, a Soft Seating Convertible Chair is made of shredded foam inside the body in order to achieve an optimal balance between comfort and support for the end user. In the depicted embodiment, such foam material can also be compressed during product shipment, thereby allowing the Soft Seating Convertible Chair to be packed tightly in a shipping container (e.g., a carton) without impacting the functionality of the finished product. By way of example and not of limitation, cut foam can also be used inside the Soft Seating Convertible Chair.

In another embodiment, a Soft Seating Convertible Chair is designed and configured with a unique wrinkle-proof soft knitted material that can be compressed without producing any wrinkles in the material of the Soft Seating Convertible Chair or in the finished product.

In an embodiment, a method of using a Soft Seating Convertible Chair by the consumer is provided, the method comprising the steps of: positioning a Soft Seating Convertible Chair on the floor; the chair configured with a seat connected by a hinge to the back side of the chair; and pushing the back side down or up to convert the chair into a table and vice versa.

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

BRIEF DESCRIPTION OF THE DRAWINGS

Certain embodiments are shown in the drawings. However, it is understood that the present disclosure is not limited to the arrangements and instrumentality shown in the attached drawings.

Figure 1:
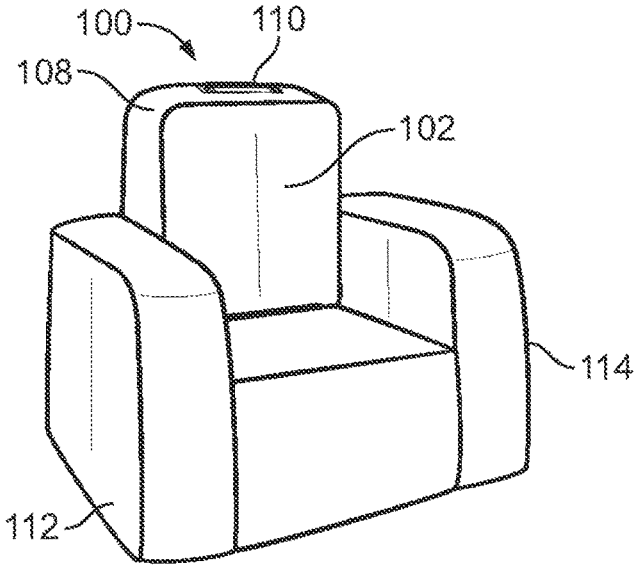
FIGS. 1 through 5 show various views of an embodiment of a Soft

Seating Convertible Chair.

FIGS. 6 through 12 show various views and configuration details of an embodiment of a Soft Seating Convertible Chair.

DETAILED DESCRIPTION OF THE INVENTION

For the purposes of promoting and understanding the principles disclosed herein, reference is now made to the preferred embodiments illustrated in the drawings, and specific language is used to describe the same.

It is understood that no limitation of the scope of the invention is hereby intended. Such alterations and further modifications in the illustrated devices and such further applications of the principles disclosed and illustrated herein are contemplated as would normally occur to one of ordinary skill in the art to which this invention relates.

In an embodiment of the present disclosure, a modular Soft Seating Convertible Chair comprises a combination of materials and is uniquely designed and configured with a plurality of common zippers and/or snaps and straps to employ the convertible feature—thereby converting the chair for various types of seating arrangements. By way of example and not of limitation, in the depicted embodiment of the present disclosure, the Soft Seating Convertible Chair comprises a combination of materials having a plurality of embedded zippers and snaps/straps (and other similar arrangements providing similar functionality) uniquely configured to convert from a chair to a table based on the user preferences.

In another embodiment of the present disclosure, a Soft Seating Convertible Chair has a body with a seat, the body having a front side and a back side spaced apart along a longitudinal direction. The body further comprises a pair of side armrests spaced apart along a transverse direction perpendicular to the longitudinal direction; the seat is positioned between the armrests and supports a seated person. The armrests are attached to the opposite and lateral sides of a seat and the hinged back side is capable of pivoting about a generally horizontal pivot axis extending along the transverse direction.

In another embodiment of the present disclosure, a plastic board is embedded within the back side of the Soft Seating Convertible Chair. In the depicted embodiment, internal baffles are positioned at a predetermined location within the armrests and the back side, and at least two webbing straps are attached at opposite ends of the chair in proximity to the armrests. The Soft Seating Convertible Chair further comprises a plurality of separating common zippers embedded on either side of the chair and configured to attach the back of the chair to the seat and the armrests. In the depicted embodiment, the Soft Seating Convertible Chair can be converted into a chair or a table by using the common zippers and pivoting the back side to create the convertible feature.

In another embodiment of the present disclosure, a method of using a Soft Seating Convertible Chair by the consumer and/or the end-user is provided. The method of converting a Soft Seating Convertible Chair into a table and vice versa comprises the steps of: (1) positioning a chair body having a seat and a front side and a back side spaced apart along a longitudinal direction on a floor; (2) configuring a pair of side armrests spaced apart along a transverse direction perpendicular to the longitudinal direction of the chair body; (3) positioning the seat between the armrests to support the position of a seated person and attaching the armrests to the opposite and lateral sides of the seat; (4) embedding a board at a pre-determined location within the back side of the chair body; (5) positioning internal baffles at a predetermined location within the armrests and the back side; (6) attaching a plurality of webbing straps at opposite ends of the chair in proximity to the armrests; (7) configuring a plurality of separating common zippers embedded on either side of the chair to attach the back of the chair body to the seat and the armrests; (8) wherein the back side of the chair body is hinged and capable of pivoting about a generally horizontal pivot axis extending along the transverse direction; and (9) using the plurality of separating common zippers while pivoting the back side of the Soft Seating Convertible Chair about a generally horizontal pivot axis extending along the transverse direction within the body of the chair to convert the chair body into a table or vice versa.

The references shown above in detail, describing the embodiments of the invention, are provided by way of explanation of the invention, not in limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment.

It is intended that the present invention cover such modifications and variations as come within the scope of the appended claims and their equivalents. Other objects, features and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

The advantages of the present invention will be set forth in and apparent from the description that follows, as well as will be learned by practice of the invention. Additional advantages of the invention will be realized and attained by the methods and systems particularly pointed out in the written description and claims hereof, as well as from the appended drawings.

FIGS. 1 through 5 illustrate various views of an embodiment of a Soft Seating Convertible Chair according to one or more aspects described herein.

Figure 2:
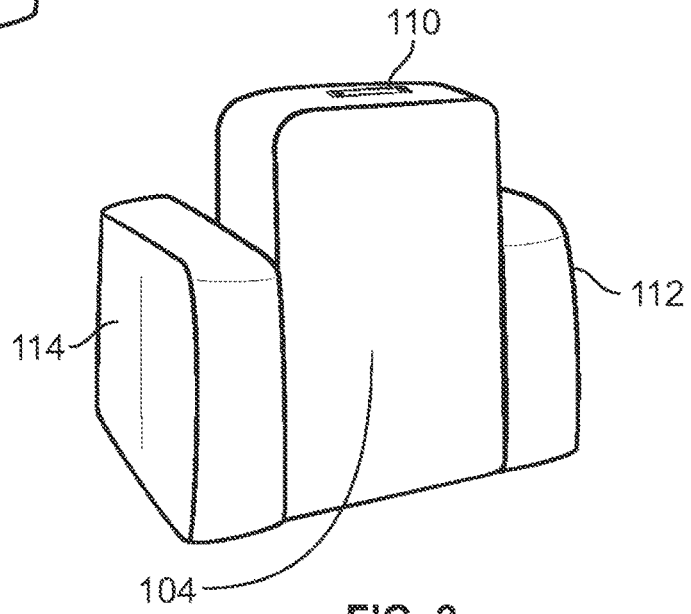

FIGS. 1 and 2 illustrate a perspective of an assembled front view and a back view of an embodiment of a Soft Seating Convertible Chair 100. In the depicted embodiment, the Soft Seating Convertible Chair 100 comprises a modular and compact body with two armrests 112, 114 at opposite lateral sides of the seat attached to the back side 104 of the chair. In the depicted embodiment, the Soft Seating Convertible Chair 100 is hinged (and pivots) on the back side 104 to provide for the convertibility from a chair to a table and vice versa. As further illustrated in the depicted embodiment in FIGS. 1 and 2, the Soft Seating Convertible Chair 100 is configured with a flat handle 110 which can be used by the consumer to convert the chair into a table or vice versa.

Figure 3:
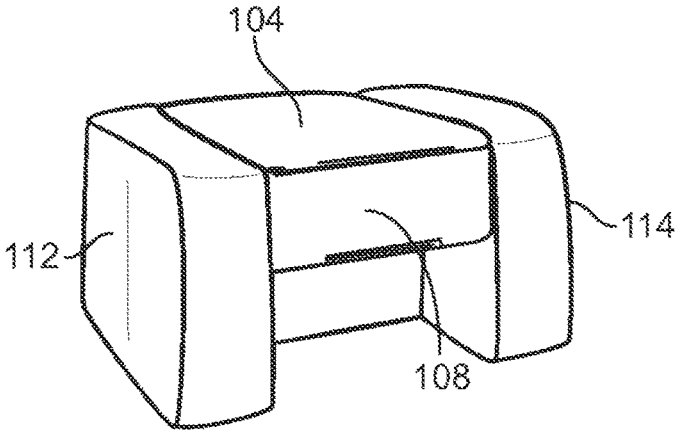
Figure 4:
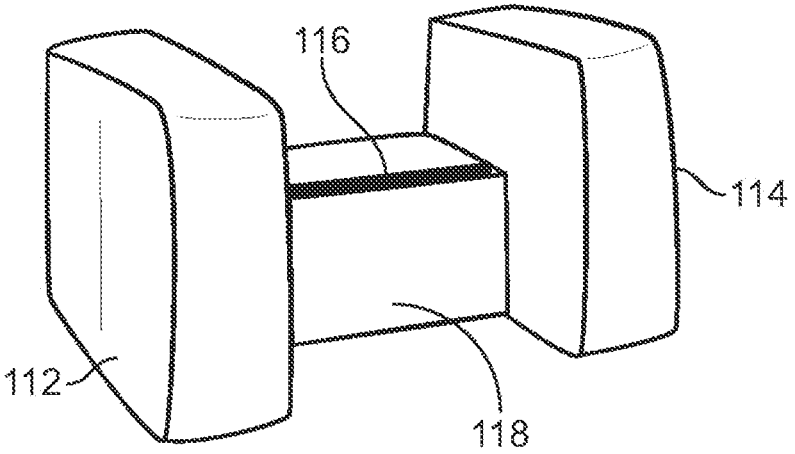
Figure 5:
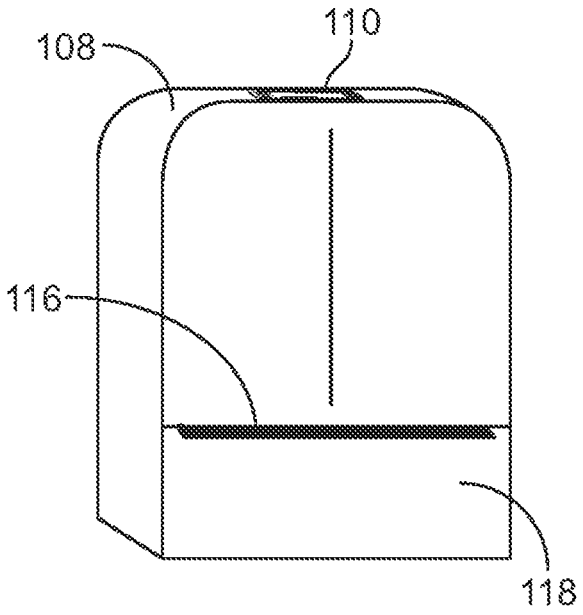
Figure 6:
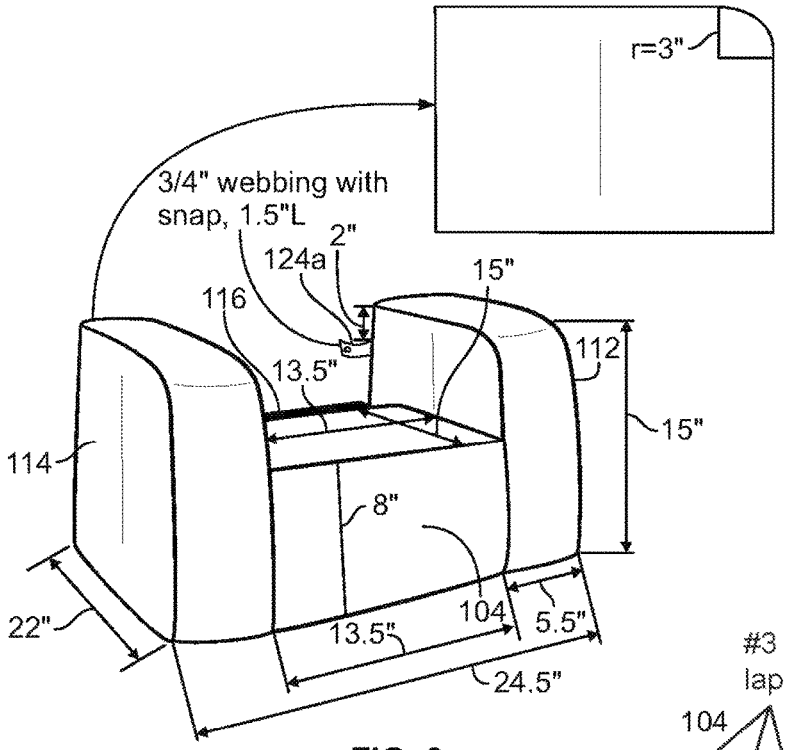
Figure 7:
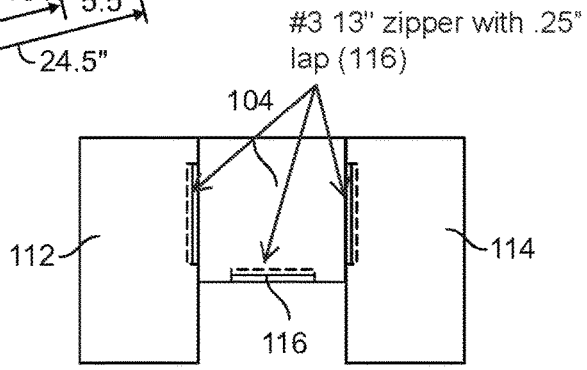

FIGS. 3 and 4 illustrate different back views of an embodiment of a Soft Seating Convertible Chair 100—illustrating how the Soft Seating Convertible Chair can be used as a chair or a table. FIG. 5 illustrates a perspective of an unassembled front view of the back side of an embodiment of a Soft Seating Convertible Chair 100. As shown, the Soft Seating Convertible Chair 100 further includes a plurality of webbing straps with snaps 124*a*, 124*b*.

FIGS. 6 through 12 show views and configuration details of various elements of an embodiment of a Soft Seating Convertible Chair 100. The Soft Seating Convertible Chair 100 further includes a ¼-inch webbing strap with snaps 124*a*, 124*b*. As further illustrated in FIG. 7, the Soft Seating Convertible Chair comprises built-in embedded common zippers closure means 116 configured to create the convertible feature. Further, the embedded common zippers closure means 116 are used on either side of the chair (back of the seat) to attach the back of the chair to the arms 112, 114 and the base of the chair.

Figure 8:
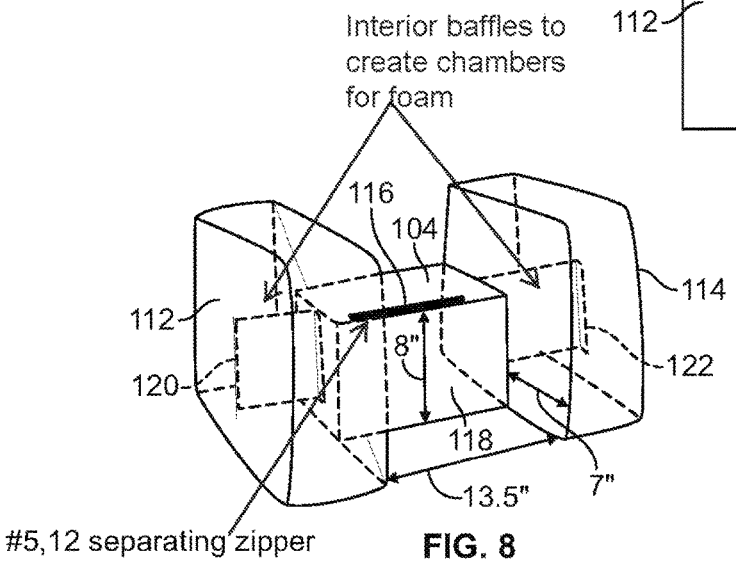
Figure 9:
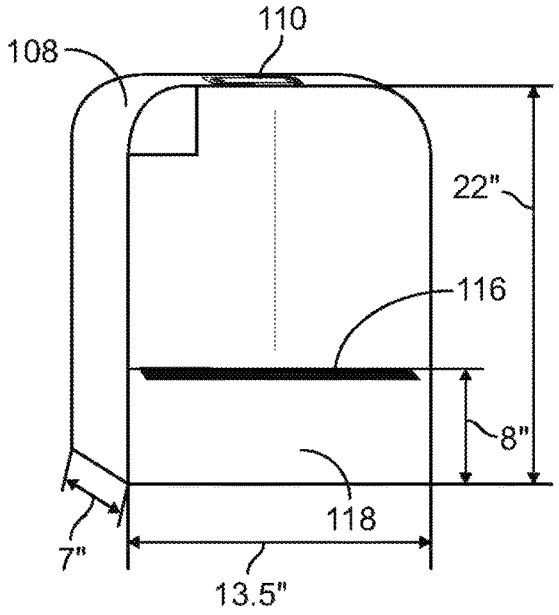

As illustrated in FIGS. 8 and 9, the Soft Seating Convertible Chair comprises built-in internal baffles 120 and 122 to create chambers for the foam. The built-in internal baffles 120 and 122 are further configured to be positioned within the armrests 112, 114 creating secure chambers for the internal material (e.g., foam) used in the product. By way of example and not of limitation in the depicted embodiment, the Soft Seating Convertible Chair 100 has an overall dimensional length, width and height of 24.5, 22 and 15 inches, respectively; a seat width of 13.5 inches and a seat height of 8 inches. In the depicted embodiment, the Soft Seating Convertible Chair 100 may also include, in addition to the common separating zippers, webbing straps/snaps 124*a*, 124*b* and various other similarly configured straps/snaps. It is to be noted that as illustrated in FIGS. 8 and 9, the separating zippers 116 provide flexible configuration for the end user to employ the convertible feature and convert the chair to a table or vice versa.

Figure 10:
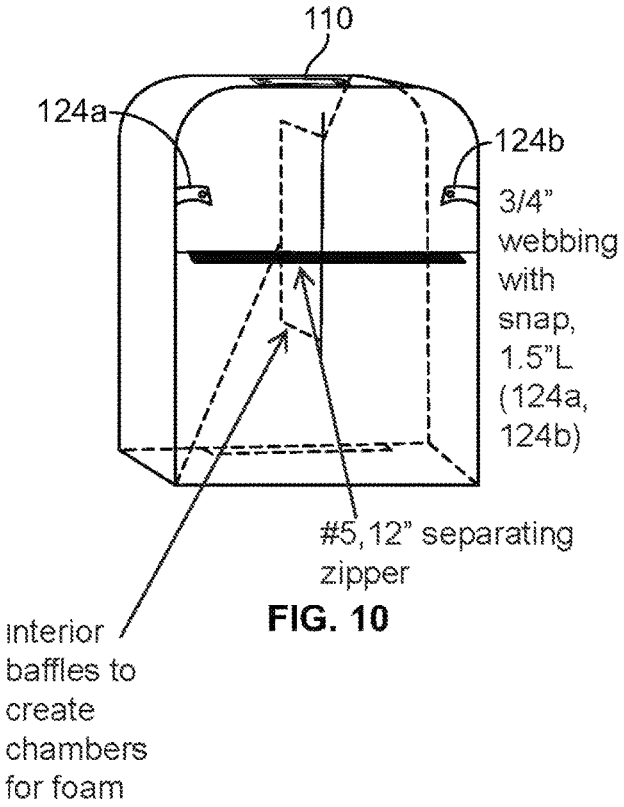
Figure 11:
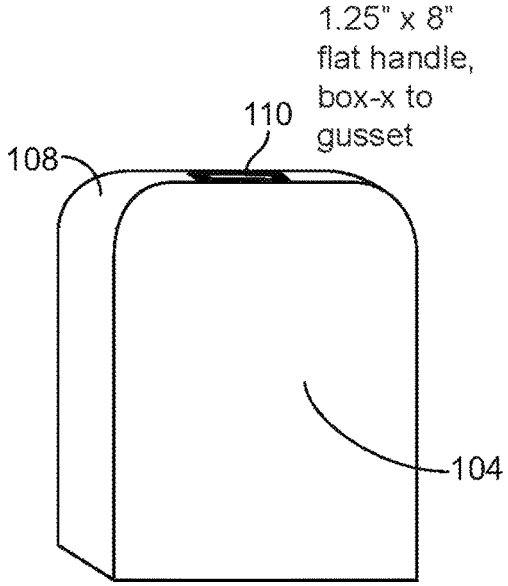
Figure 12:
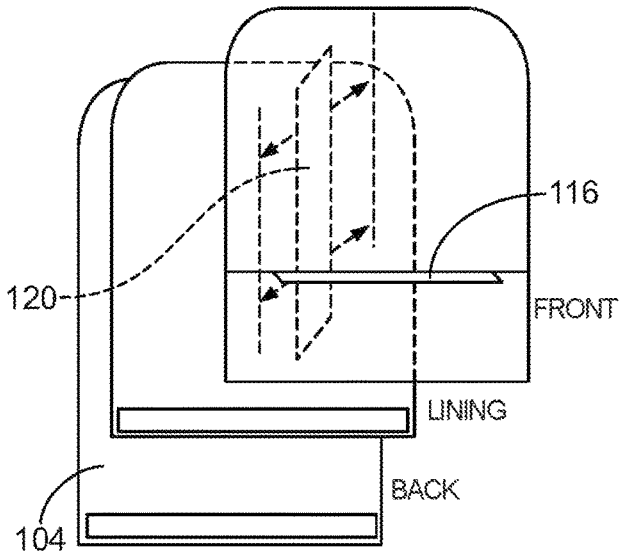

FIG. 10 shows the configuration and design details of various elements of an embodiment of a Soft Seating Convertible Chair 100. As illustrated in FIG. 10, the Soft Seating Convertible Chair 100 comprising ¼-inch webbing straps with snaps 124*a* and 124*b* can have a pre-configured webbing and a predetermined positioning for attachment to the body. By way of example and not of limitation, other similarly configured straps/snaps can be positioned at other predetermined distances along the Soft Seating Convertible Chair to provide flexible configuration for the end user. FIG. 11 illustrates the back view of the Soft Seating Convertible Chair wherein the handle 110 has certain predetermined specific dimensions. Finally, as illustrated in FIG. 12, the back side of the Soft Seating Convertible Chair has an embedded board inside the product to create a firm table top. By way of example and not of limitation, the board embedded within the back side of the chair comprises plastic, wood or paper or other similar material providing equivalent functionality.

It is understood that the preceding is merely a detailed description of some examples and embodiments of the present invention, and that numerous changes to the disclosed embodiments may be made in accordance with the disclosure made herein without departing from the spirit or scope of the invention.

The references shown above of the invention are provided by way of explanation of the invention, not limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents.

It is to be understood by one of ordinary skill in the art that the present discussion is a description of exemplary embodiments only and is not intended as limiting the broader aspects of the present invention, which broader aspects are embodied in the exemplary constructions. The above-detailed description and the examples described therein have been presented for the purposes of illustration and description only and not by limitation. It is therefore contemplated that the present disclosure cover any and all modifications, variations or equivalents that fall within the spirit and scope of the basic underlying principles disclosed above and claimed herein.

The invention claimed is:

1. A convertible chair comprising:

a body having a seat and a front side and a back side spaced apart along a longitudinal direction;

a pair of side armrests spaced apart along a transverse direction perpendicular to the longitudinal direction;

wherein the seat is positioned between the armrests and configured to support the position of a seated person, and wherein the armrests are further attached to opposite and lateral sides of the seat;

a plurality of separating common zippers embedded on either side of the chair and configured to attach the back side to the seat and the armrests of the chair body;

wherein the back side of the body is hinged and capable of pivoting about a generally horizontal pivot axis extending along the transverse direction; and wherein the plurality of separating common zippers and the pivoting back side of the chair can be used to convert the chair into a table or vice versa; and wherein a board embedded at a pre-determined location within the back side of the chair body;

a plurality of internal baffles positioned at a predetermined location within the armrest and the back side of the chair body; and a plurality of webbing straps attached at opposite ends of the chair body in proximity to the armrest.

2. The convertible chair of claim 1, wherein the body further comprises an outer shell filled with an inner material.

3. The convertible chair of claim 2, wherein the outer shell and the inner material further comprise a textile material and shredded foam, respectively.

4. The convertible chair of claim 1, wherein the chair material can comprise of a certain wrinkle-proof and easily compressible soft knitted material.

5. A Soft Seating Convertible Chair comprising:

a body having a seat and a front side and a back side spaced apart along a longitudinal direction;

a pair of side armrests spaced apart along a transverse direction perpendicular to the longitudinal direction;

wherein the seat is positioned between the armrests and configured to support the position of a seated person, wherein the armrests are further attached to the opposite and lateral sides of the seat;

a board embedded at a pre-determined location within the back side;

a plurality of internal baffles positioned at a predetermined location within the armrests and the back side;

a plurality of webbing straps attached at opposite ends of the chair in proximity to the armrests;

a plurality of separating common zippers embedded on either side of the chair and configured to attach the back side of the chair to the seat and the armrests;

wherein the back side of the body is hinged and capable of pivoting about a generally horizontal pivot axis extending along the transverse direction; and wherein the plurality of separating common zippers and the pivoting the back side can be used to convert the chair into a table or vice versa.

6. The Soft Seating Convertible Chair of claim 5, wherein the board embedded within the back side of the chair comprises of plastic, wood or other similar material providing equivalent functionality.

7. The Soft Seating Convertible Chair of claim 5, wherein the plurality of webbing straps attached at opposite ends of the chair in proximity to the armrests comprises at least two straps.

8. The Soft Seating Convertible Chair of claim 7, wherein the plurality of webbing straps attached at opposite ends of the chair in proximity to the armrests comprises pre-configured webbing thickness.

9. The Soft Seating Convertible Chair of claim 8, wherein each of the webbing straps attached at opposite ends of the chair in proximity to the armrests is a ¾ inch strap.

10. The convertible chair of claim 5, wherein the body further comprises an outer shell filled with an inner material.

11. The Soft Seating Convertible Chair of claim 10, wherein the outer shell and the inner material further comprise textile material and shredded foam, respectively.

12. The Soft Seating Convertible Chair of claim 5, wherein the chair can comprise of a certain wrinkle-proof and easily compressible soft knitted material.

13. A method of converting a Soft Seating Convertible Chair into a table and vice versa, the method comprising the steps of:

positioning a chair body having a seat and a front side and a back side spaced apart along a longitudinal direction on a floor;

configuring a pair of side armrests spaced apart along a transverse direction perpendicular to the longitudinal direction of the chair body;

positioning the seat between the armrests to support the position of a seated person and attaching the armrests to opposite and lateral sides of the seat;

embedding a board at a pre-determined location within the back side of the chair body;

positioning a plurality of internal baffles at a predetermined location within the armrests and the back side;

attaching a plurality of webbing straps at opposite ends of the chair in proximity to the armrests;

configuring a plurality of separating common zippers embedded on either side of the chair to attach the back of the chair body to the seat and the armrests;

wherein the back side of the chair body is hinged and capable of pivoting about a horizontal pivot axis extending along the transverse direction; and using the plurality of separating common zippers while pivoting the back side of the Soft Seating Convertible Chair about the horizontal pivot axis extending along the transverse direction within the body of the chair to convert the chair body into a table or vice versa.

14. The method of converting a Soft Seating Convertible Chair into a table and vice versa of claim 13, wherein the board embedded within the back side of the chair comprises plastic, wood or other similar material providing equivalent functionality.

15. The method of converting a Soft Seating Convertible Chair into a table and vice versa of claim 13, wherein the plurality of webbing straps attached at opposite ends of the chair in proximity to the armrests comprise at least two straps.

16. The method of converting a Soft Seating Convertible Chair of claim 15 into a table and vice versa, wherein the plurality of webbing straps attached at opposite ends of the chair in proximity to the armrests comprise certain pre-configured webbing thickness.

17. The method of converting a Soft Seating Convertible Chair of claim 15 into a table and vice versa, wherein each of the webbing straps is attached at opposite ends of the chair in proximity to the armrests is a ¾ inch strap.

18. The method of converting a Soft Seating Convertible Chair of claim 13 into a table and vice versa, wherein the body further comprise an outer shell filled with an inner material.

19. The method of converting a Soft Seating Convertible Chair of claim 13 into a table and vice versa, wherein the outer shell and the inner material further comprise textile material and shredded foam, respectively.

* * * * *